US009112306B2

(12) United States Patent
Kiyooka

(10) Patent No.: US 9,112,306 B2
(45) Date of Patent: Aug. 18, 2015

(54) CONNECTOR

(71) Applicant: PANASONIC CORPORATION, Osaka (JP)

(72) Inventor: Takashi Kiyooka, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/023,389

(22) Filed: Sep. 10, 2013

(65) Prior Publication Data

US 2014/0073155 A1 Mar. 13, 2014

(30) Foreign Application Priority Data

Sep. 11, 2012 (JP) ..... 2012-199181

(51) Int. Cl.

| | |
|---|---|
| ***H01R 13/629*** | (2006.01) |
| ***H01R 12/88*** | (2011.01) |
| *H01R 12/77* | (2011.01) |
| *H01R 13/24* | (2006.01) |

(52) U.S. Cl.

CPC ..... *H01R 13/62994* (2013.01); *H01R 12/88* (2013.01); *H01R 13/62977* (2013.01); *H01R 12/771* (2013.01); *H01R 13/2435* (2013.01); *H01R 13/2442* (2013.01)

(58) Field of Classification Search

CPC ..... H01R 13/62994

USPC ..... 439/260, 261, 266, 267, 492–495

See application file for complete search history.

(56) References Cited

U.S. PATENT DOCUMENTS

| | | | | |
|---|---|---|---|---|
| 5,906,498 | A * | 5/1999 | Nagafuji | 439/260 |
| 7,094,093 | B2 * | 8/2006 | Nakano et al. | 439/495 |
| 7,140,896 | B2 * | 11/2006 | Takai et al. | 439/260 |
| 2010/0130044 | A1 * | 5/2010 | Taketomi | 439/260 |
| 2014/0057475 | A1 * | 2/2014 | Tohjo | 439/329 |
| 2014/0073155 | A1 * | 3/2014 | Kiyooka | 439/157 |

FOREIGN PATENT DOCUMENTS

JP 2008-004404 A 1/2008

* cited by examiner

*Primary Examiner* — James Harvey

(74) *Attorney, Agent, or Firm* — McDermott Will & Emery LLP

(57) ABSTRACT

A connector includes: at least one of a contact 5; a housing 3 accommodating the contact 5; an insertion opening 4 to which a flat cable 2 can be inserted, the insertion opening 4 being provided in front part of the housing 3 and being defined by upper and lower walls 33 and 32 of the housing 3 at the top and bottom; and a lever 6 which is provided in back part of the housing 3 and includes cam portions 61 which bring the contact 5 into pressure contact with the flat cable 2 and establish electrical continuity therebetween when the lever 6 is turned. The contact 5 includes a contact 5A having a placement surface S1 which is located at a substantially same height position in the vertical direction as a contact surface S2 of the corresponding cam portion 61 in the housing 3.

8 Claims, 8 Drawing Sheets

CONNECTOR

CROSS REFERENCE TO RELATED APPLICATIONS

This application is based upon and claims the benefit of priority from prior Japanese Patent Application P2012-199181 filed on Sep. 11, 2012; the entire contents of which are incorporated by reference herein.

BACKGROUND OF THE INVENTION

The present invention relates to a connector.

Conventionally-known connectors include front-lock connectors having a lever in the front part of the housing (in the insertion opening side) and back-lock connectors having a lever in the back part of the housing.

The housing accommodates electrically-conductive contacts. Each contact includes a pair of arms which are positioned on the upper and lower sides of a flat cable. The flat cable is inserted between the pair of arms. When the lever is operated in this state, the pair of arms sandwich the upper and lower surfaces of the flat cable with the front ends thereof about a fulcrum, provided between the both arms, as a center.

In this process, the rotation force of the lever acts on the front end side of each arm with respect to the fulcrum in a front-lock connector. On the other hand, in a back-lock connector, the rotation force of the lever acts on the back end side of each arm with respect to the fulcrum. In other words, the front-lock connector is configured to hold the flat cable by causing the rotation force of the lever to directly act in such a direction as to close the front end of the connector. On the other hand, the back-lock connector holds the flat cable at the front end, which is closed by causing the rotation force of the lever to act in such a direction as to open parts of the arms backward of the fulcrum of the connector. The front-lock and back-lock connectors, therefore, differ from each other in position where the rotation force of the lever acts on the contacts, such as forward of or backward of the fulcrum. However, the back-lock connectors can include space to accommodate the laid-down lever in the backward of the contacts and can have a lower profile than the front-lock connectors have.

Japanese Patent Laid-open Publication No. 2008-4404 describes a back-lock connector. In the back-lock connector, the cam portion made of synthetic resin is configured to slide on an insulator made of synthetic resin while minimizing sliding on the metallic contacts. This can very effectively prevent the cam portion from being worn even when an actuator is repeatedly turned, and the cam portion can, therefore, keep the shape thereof.

SUMMARY OF THE INVENTION

The connectors are increasingly demanded to have a lower profile as electronic devices are miniaturized. However, a conventional connector includes a number of constituent parts around the cam portion, and it is, therefore, difficult to reduce the height of the connector.

Hereinafter, a description is given of the aforementioned problem of the conventional connectors in more detail, using FIG. 1. Specifically, as indicated by A of FIG. 1, a contact 5 includes a moving arm 52 and a fixed arm 51 which are joined to form a substantially H-shape. In the back part of the housing 3, a lever 6 is provided. At an end of the lever 6, a cam portion 61 is provided. As illustrated by A of FIG. 1, the lever 6 is raised in an unlocked position at the initial state. After a flat cable 2 is inserted into the insertion opening 4, the lever 6 is turned backwards into the locked position as illustrated by B and C of FIG. 1. In the locked position, the flat cable 2 and contacts 5 establish electrical continuity. The portion indicated by reference numeral 52C of C in FIG. 1 is at the highest position in the moving arm 52. The higher the maximum point, the more difficult it is to reduce the height of the connector.

Accordingly, an object of the present invention is to provide a connector which can be reduced in height.

The present invention is a connector, including: at least one of a contact; a housing accommodating the contact; an insertion opening to which a flat cable can be inserted, the insertion opening being provided in front part of the housing and being defined by upper and lower walls of the housing at the top and bottom; and a lever which is provided in back part of the housing and includes cam portions which bring the contact into pressure contact with the flat cable and establish electrical continuity therebetween when the lever is pivoted. In the connector, the contact includes a first contact having a placement surface which is located at a substantially same height position in the vertical direction as a contact surface of the corresponding cam portion in the housing.

In the present invention, the connector may include a plurality of contacts and the contacts may include a second contact having a different effective fitting length from that of the first contact.

Moreover, in the present invention, the contacts may include a moving arm and a fixed arm which are joined to form a substantially H shape, the moving arm being driven by the corresponding cam portion, the fixed arm being fixed to the housing, and the fixed arm of the first contact may be shorter than the moving arm and may be provided to face the moving arm together with the corresponding cam portion.

Furthermore, in the present invention, an end face of the fixed arm of the first contact may face the corresponding cam portion, the end face being located at an end of the fixed arm in the horizontal direction.

Still furthermore, in the present invention, the cam portion corresponding to the first contact may rotate on the lower wall of the housing as a contact surface.

Still furthermore, in the present invention, when the lever is turned, the cam portion corresponding to the first contact may apply pressure to the first contact while the cam portion corresponding to the second contact prevents the lever from falling off.

Still furthermore, in the present invention, the cam portion corresponding to the second contact may be columnar.

Still furthermore, in the present invention, the first contact may have an effective fitting length shorter than that of the second contact and may be located at an odd-numbered position from an end while the second contact is located at an even-numbered position from the end.

DETAILED DESCRIPTION OF THE PREFERRED EMBODIMENTS

Hereinafter, a description is given of an embodiment of the present invention in detail with reference to the drawings.

FIGS. 2 to 8B (except FIGS. 7A and 7B) are views illustrating an embodiment of a connector 1 according to the present invention. The connector 1 connects a flat cable 2, such as an FPC (flexible printed circuit) or an FFC (flexible flat cable), to a circuit substrate C (see FIGS. 8A and 8B) to establish electrical continuity therebetween.

Figure 2:
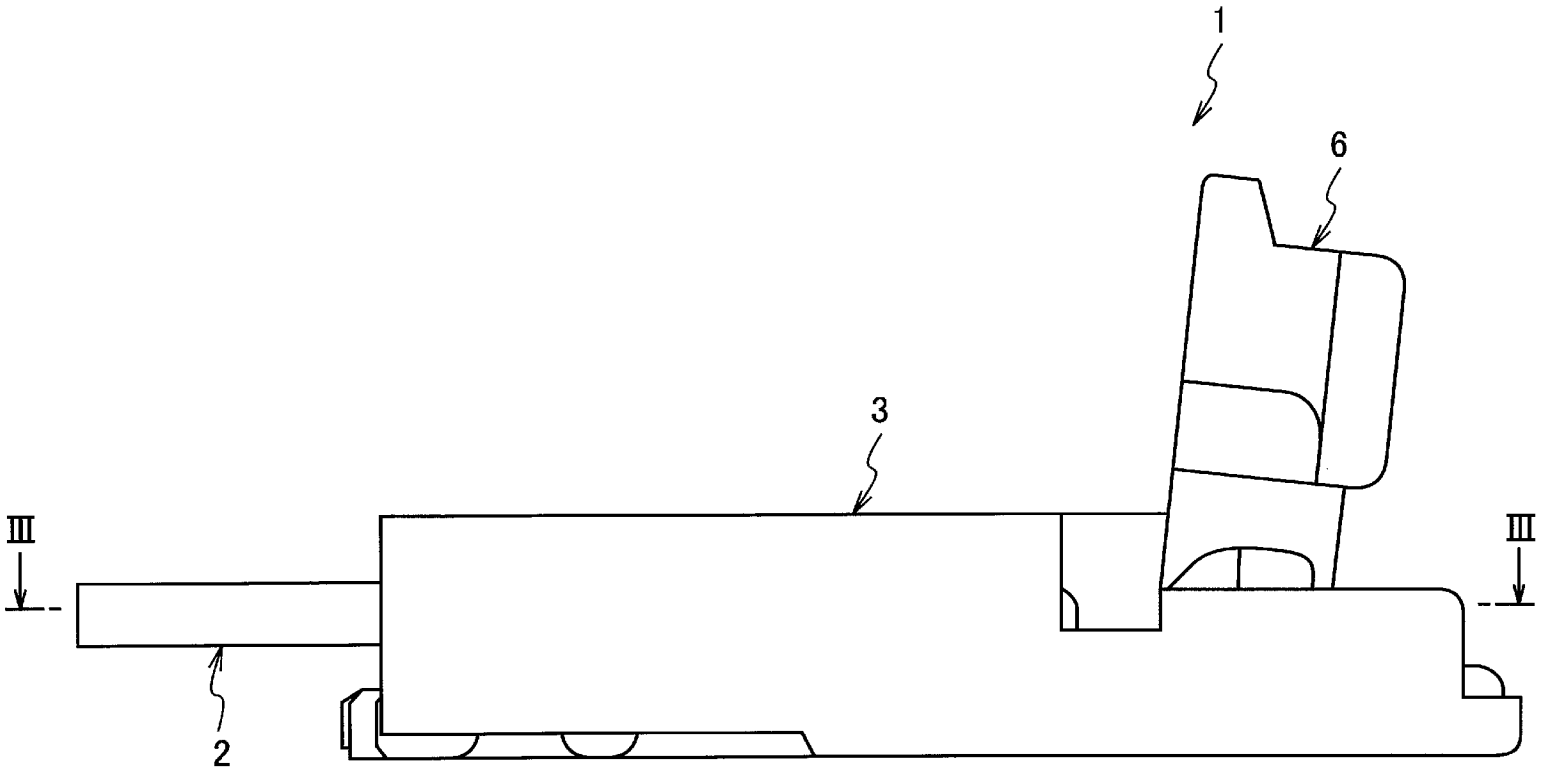
FIG. 2 is a side view of a connector according to an embodiment of the present invention.
Figure 3:
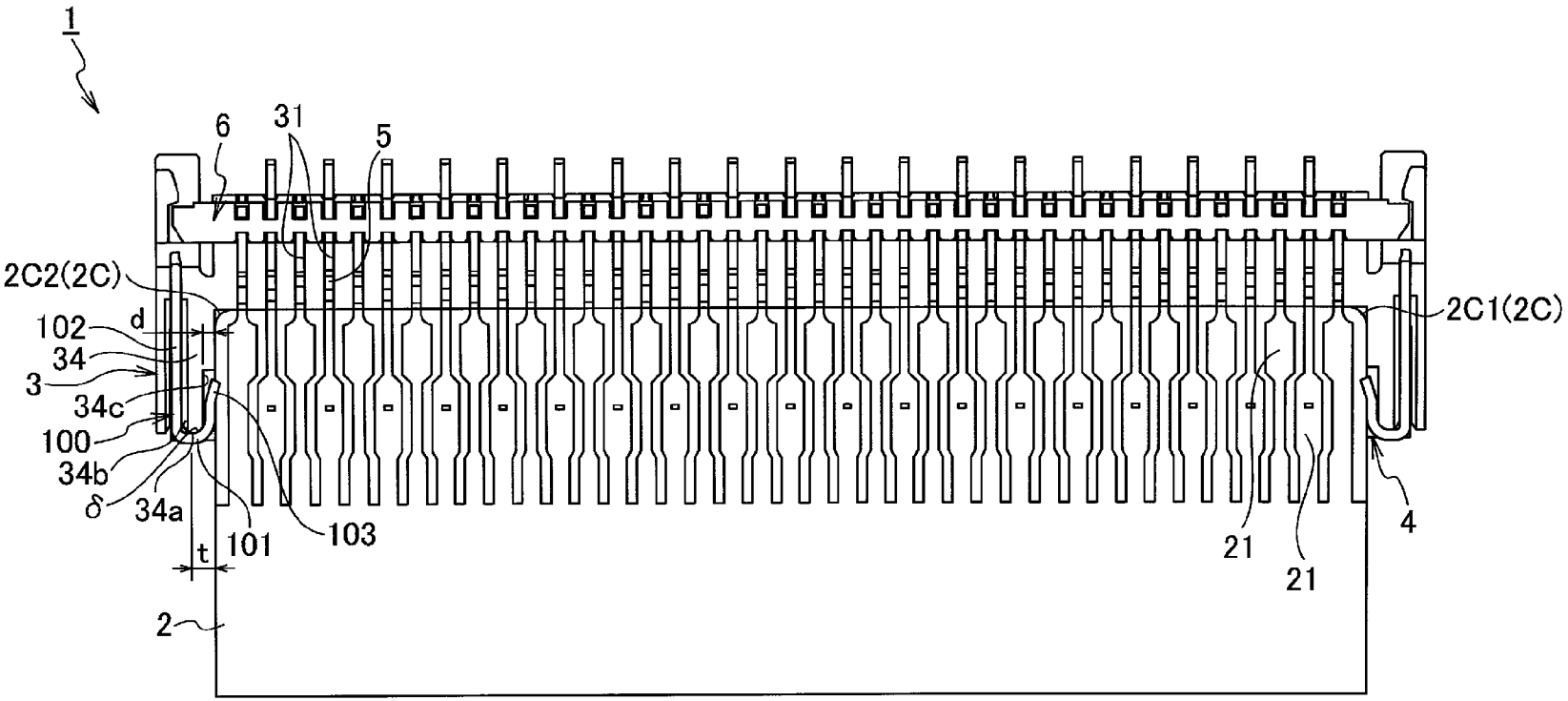
FIG. 3 is a cross-sectional view taken along a line of FIG. 2.

As illustrated in FIGS. 2 and 3, the connector 1 includes an insulating housing 3. In the front part (lower part in FIG. 3) of the housing 3, an insertion opening 4 is provided, into which the flat cable 2 can be inserted. The housing 3 accommodates plural conductive contacts 5 that can be freely connected to the flat cable 2 inserted into the insertion opening 4 to establish electrical continuity therebetween. The contacts 5 are arranged side by side in an orderly fashion.

In the back part (upper part in FIG. 3) of the housing 3, a lever 6 is attached. The lever 6 is turned to bring the contacts 5 into pressure contact with the flat cable 2 so that the contacts 5 and flat cable 2 are connected to establish electrical continuity therebetween.

The housing 3 is made of an insulating material such as synthetic resin. The housing 3 includes plural slots 31 to which the contacts 5 are attached. The slots 31 penetrate in the front-back direction of the housing 3 (in the vertical direction of FIG. 3) and are arranged in the cross direction (in the width direction: in the horizontal direction of FIG. 3). The width of each slot 31 is defined by partition walls 35. Each partition wall 35 includes a cutout portion 35*a* which is opened toward the front side and allows the flat cable 2 to be inserted therein. The plural contacts 5 are attached to the respective slots 31 and are thereby arranged side by side in an orderly fashion.

Figure 4:
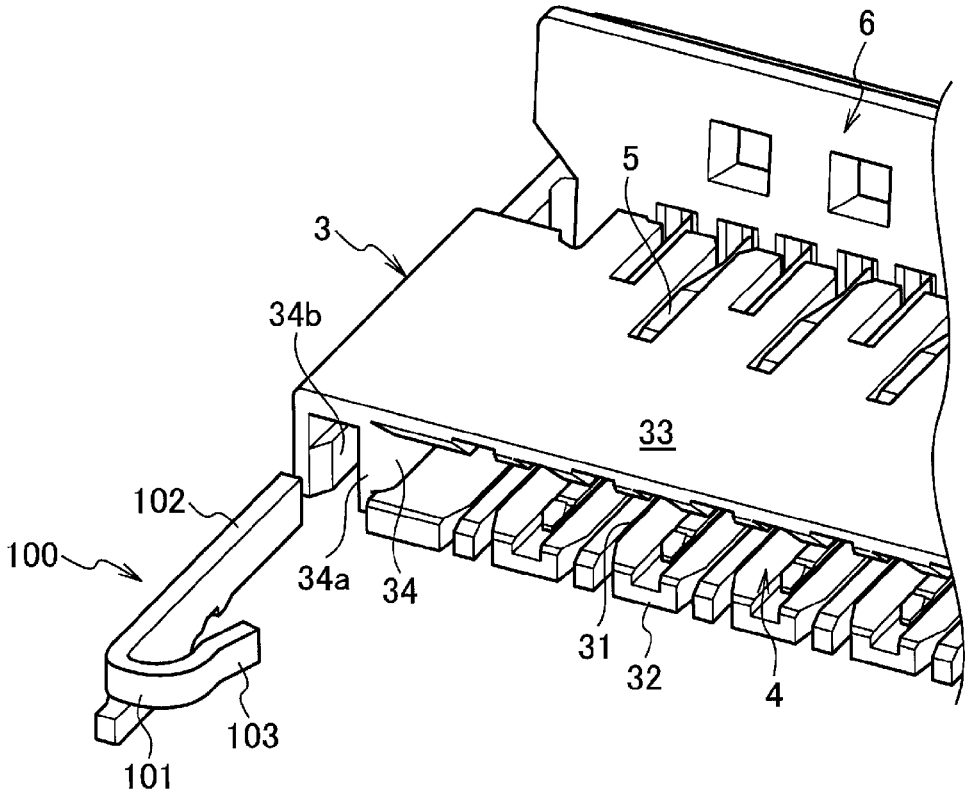
FIG. 4 is a perspective view illustrating attachment of a protection member illustrated in FIG. 3.

As illustrated in FIG. 4, the insertion opening 4 is defined by a lower wall 32, an upper wall 33, and side walls 34 as a flat rectangular shape extending in the cross-direction. More specifically, the insertion opening 4 is defined by the upper and lower walls 33 and 32 of the housing 3 at the top and bottom and is defined by the side walls 34 at both ends in the width direction. As a matter of course, the opening area of the insertion opening 4 has vertical and horizontal dimensions commensurate with the thickness and width of the flat cable 2. The housing 3 only needs to define the top and bottom of the insertion opening 4 with the upper and lower walls 33 and 32, and the both ends of the insertion opening 4 may be defined by side walls made of a material different from the housing 3 (for example, metallic plates, resin plates, or the like).

The contacts 5 are formed by using a press for punching out a conductive material sheet having a predetermined thickness, for example. Each of the thus-formed contacts 5 includes a bar-shaped fixed arm 51 and a bar-shaped moving arm 52. The fixed arm 51 extends in the front-back direction (in the vertical direction in FIG. 3). The moving arm 52 extends in the same direction as the fixed arm 51 extends and faces the fixed arm 51 in the thickness direction of the flat cable 2. The fixed and moving arms 51 and 52 have longitudinally intermediate portions joined with a joint spring portion 53 to form a substantially H shape as a whole (see FIGS. 8A and 8B). The joint spring portion 53 serves as a fulcrum when the moving arm 52 opens or closes. At the back end of the fixed arm 51, a terminal portion 51*b*, which is mounted on the circuit substrate C, is provided. Through the terminal portion 51*b*, the contact 5 and the circuit substrate C establish electrical continuity. Furthermore, the back end of the moving arm 52 includes a spring portion 52*b*.

Figure 8A:
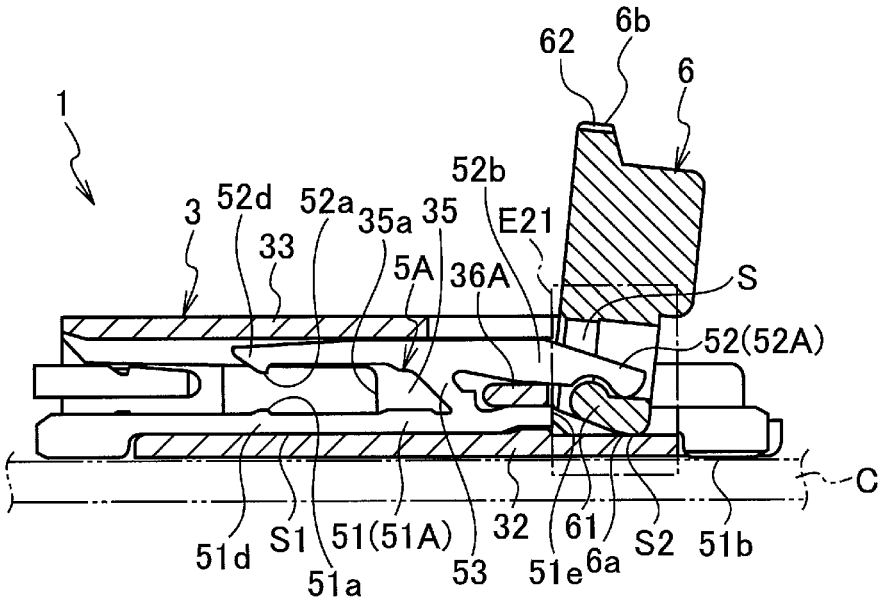
FIGS. 8A and 8B are cross-sectional views schematically illustrating the connector according to the embodiment of the present invention, FIG. 8A being a cross-sectional view of an odd-numbered contact, FIG. 8B being a cross-sectional view of an even-numbered contact.
Figure 8B:
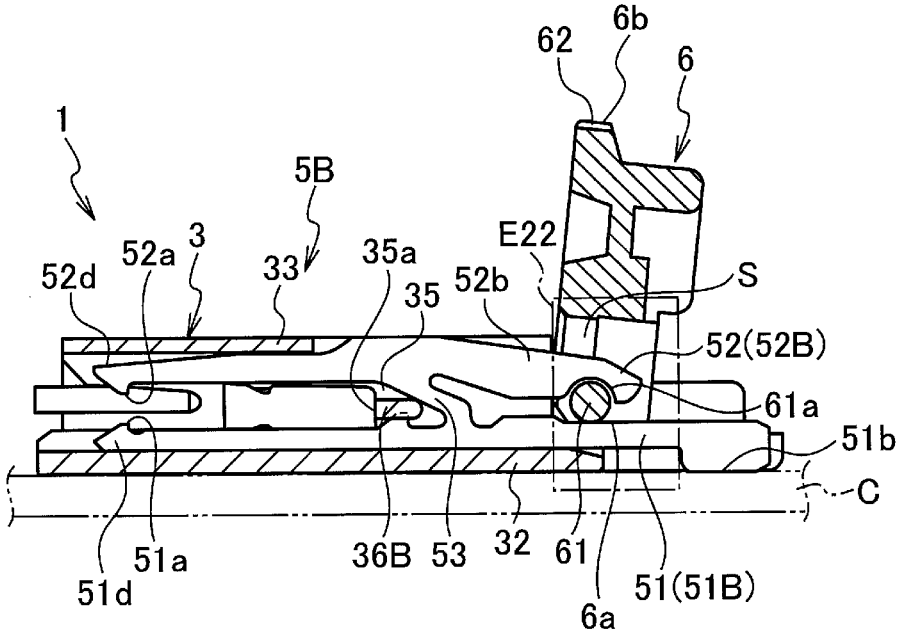

The lever 6 is integrally molded by injection molding of an insulating material such as synthetic resin and includes a cam portion 61 at an end 6*a* (at the lower end in FIGS. 8A and 8B). The cam portion 61 produces pressing force at the fixing arm contact portion 51*a* and moving arm contact portion 52*a* of each contact 5 in the closing direction. At the other end 6*b* (at the upper end in FIGS. 8A and 8B), an operating portion 62 for turning the lever 6 is provided. In this embodiment, the height of the connector 1 is reduced by reducing the number of constituent parts around the cam portion 61 (described later).

The lever 6 is raised in an unlocked position at the initial state. Meanwhile, the lever 6 is brought into the locked position when turned backward to be laid down after the flat cable 2 is inserted into the insertion opening 4. In this locked position, the flat cable 2 and contacts 5 establish electrical continuity therebetween. Specifically, when the operation portion 62 of the lever 6 is turned backward to be laid down, the cam portion 61 works so as to push apart the back ends of the fixed and moving arms 51 and 52 of each contact 5. The fixed arm 51 and moving arm 52 then move so that the front ends 51*d* and 52*d* are closed about the joint spring portion 53 as the fulcrum. Therefore, the fixed and moving arm contact portions 51*a* and 52*a*, which are provided for the front ends 51*d* and 52*d* of the fixed and moving arms 51 and 52, respectively, can strongly sandwich the both surfaces of the flat cable 2. This can prevent the flat cable 2 from falling off while establishing the electrical continuity between the contacts 5 and flat cable 2.

As described above, in the back-lock connector 1, the lever 6 can be provided in the backward of the contacts 5 so as not to overlap the contacts 5 when the lever 6 is in the locked position. This can facilitate reducing the height of the connector 1 compared to front-lock connectors.

Figure 5:
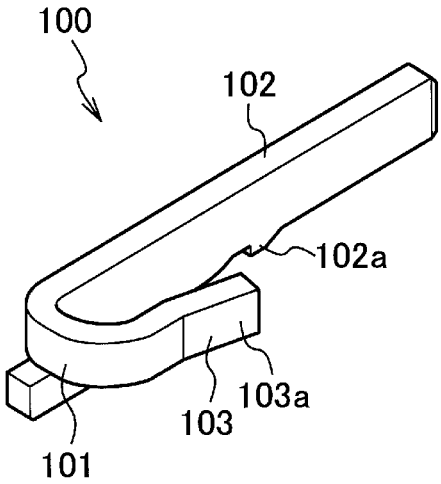
FIG. 5 is an enlarged perspective view of the protection member illustrated in FIG. 4.

As illustrated in FIGS. 3 and 4, in the insertion opening 4, into which the flat cable 2 is inserted, protection members 100 protecting the side walls 34 of the insertion opening 4 are provided. As illustrated in FIG. 5, each protection member 100 includes a straight attachment portion 102. An end of the straight attachment portion 102 is bent in a U-shape, and the portion bent in the U shape constitutes a guard portion 101 protecting a front surface 34*a* of the corresponding side wall 34. The guard portion 101 is integrally formed by processing a part (the end portion) of the attachment portion 102. Preferably, the protection members 100 are entirely made of a metallic material excellent in abrasion resistance, such as phosphor bronze, brass, titanium copper, beryllium copper, and stainless, for example.

On the other hand, as illustrated in FIG. 3, an attachment hole 34*b* is formed in each side wall 34 with a predetermined thickness t left inside so as to extend in the same direction as the side wall 34 extends. In the attachment hole 34*b*, the attachment portion 102 of the protection member 100 is inserted. When the attachment portion 102 is inserted into the attachment hole 34*b*, the U-shaped guard portion 101 of the protection member 100 covers the front surface (front end) 34*a* of the side wall 34.

In the middle of the lower side of the attachment portion 102, an engagement protrusion 102*a* is provided. The engagement protrusion 102*a* is configured to be engaged with an engagement recess (not shown) provided for the attachment hole 34*b*. The engagement protrusion 102*a* is engaged with the engagement recess to be prevented from falling off.

Each of the protection members 100 includes a cable holding portion 103 extending from the end of the guard portion 101 towards the inside of the insertion opening 4. The cable holding portion 103 is configured to apply a certain pressure-energization force to both sides of the flat cable 2. In such a manner, the protection member 100 includes the guard portion 101, attachment portion 102, and cable holding portion 103, thus forming a hook shape as a whole.

While each protection member 100 is provided with the cable holding portion 103, a slot 34*c* with a depth d is provided in the inside of each side wall 34 of the insertion opening 4 as a space to accommodate the cable holding portion 103. Preferably, the depth d of the slot 34*c* is equal to or slightly larger than the thickness of the cable holding portion 103.

The cable holding portion 103 of this embodiment is extended from the end of the guard portion 101 toward the inside of the insertion opening 4 along the side wall 34, and a front end portion 103*a* thus extended is slightly bent toward the center of the insertion opening 4 in the width direction. Accordingly, the front end portion 103*a* of the cable holding portion 103 protrudes a little beyond the inner side of the side wall 34 into the insertion opening 4 in a natural state. Because of the resilient force of the guard portion 101 bent in the U shape, the cable holding portions 103 have energization force that pushes the corresponding side surface of the inserted flat cable 2.

FIG. 3 illustrates the natural state of the cable holding portion 103, and the front end portion 103*a* of the cable holding portion 103 protrudes inward beyond the corresponding side surface of the flat cable 2. However, in an actual state where the flat cable 2 is inserted into the insertion opening 4, the front end portion 103*a* of the cable holding portion 103 is pushed by the corresponding side surface of the flat cable 2 toward the outside of the side surface.

As illustrated in FIG. 3, moreover, when the protection members 100 are attached to the respective side walls 34, a predetermined gap δ is provided between the guard portion 101 of each protection member 100 and the front surface 34*a* of the corresponding side wall 34.

The surface of each protection member 100 of this embodiment is plated. The protection members 100 are attached to the respective side walls 34 of the insertion opening 4. The paired protection members 100 are placed symmetrically.

In the connector 1 of this embodiment, the terminal portions 51*b* of the contacts 5 are mounted on the circuit board C as described above. On the other hand, when the lever 6 is brought into the locked position after the flat cable 2 is inserted into the insertion opening 4 of the connector 1, the flat cable 2 and the contacts 5 establish electrical continuity. Accordingly, by bringing the lever 6 into the locked position with the flat cable 2 being inserted into the insertion opening 4, the flat cable 2 and circuit substrate C establish electrical continuity through the contacts 5.

Figure 6:
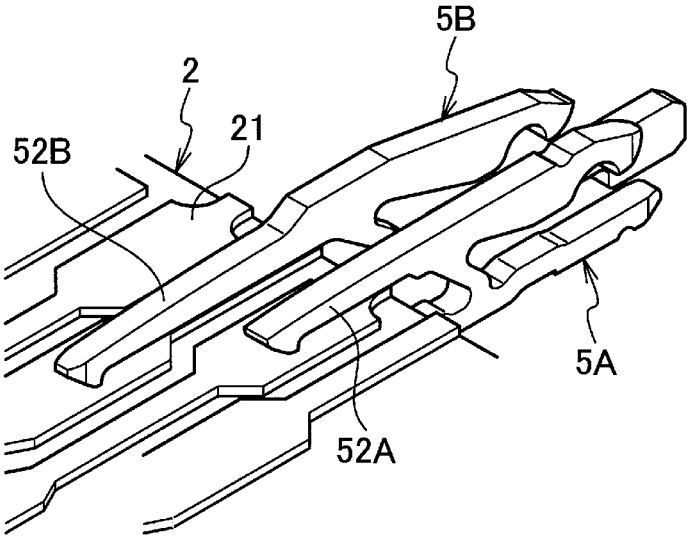
FIG. 6 is a perspective view illustrating a relationship between contacts according to the embodiment of the present invention and a flat cable.

FIG. 6 is a perspective view illustrating the relationship between the contacts 5A and 5B and the flat cable 2. As illustrated in FIG. 6, signal terminals 21 of the flat cable 2 are arranged in a zigzag manner. The two types of contacts 5A and 5B have different effective fitting length (arm length between the joint spring portion and the moving arm contact portion) so as to fit to the signal terminals 21 arranged in a zigzag manner. Specifically, the effective fitting length of the contacts 5B, which are arranged at the even-numbered positions from one end in the width direction of the housing 3, is longer than that of the contacts 5A, which are arranged at the odd-numbered positions from the one end. In this embodiment, the contacts 5A and 5B are alternately arranged side by side so that the contacts 5 at the both ends in the width direction of the housing 3 are the contacts 5A, which have short effective fitting length. Accordingly, the contacts 5A are located at odd-numbered positions from either end in the width direction of the housing 3, and the contacts 5B are located at even-numbered positions from either end in the width direction of the housing 3.

As described above, in this embodiment, the contacts 5 include the contacts (first contacts: contacts having short effective fitting length) 5A and the contacts (second contacts: contacts having long effective fitting length) 5B. The number of types of the contacts 5 is not limited to two and may be one, three, or more.

The contacts 5A are inserted (press-fitted) into the respective slots 31 from the front side (one side in the press-fit direction), and the contacts 5B are inserted (press-fitted) into the respective slots 31 from the back side (the other side in the press-fit direction). In other words, in this embodiment, the contacts 5A and 5B are inserted into the respective slots 31 in the different directions to be press-fitted into the housing 3. As for the contacts 5A, in this process, each contact 5A is inserted into between the upper and lower walls 33 and 32 of the housing 3 so that back part of the fixed arm 51A thereof is press-fitted into between the lower wall 32 and a joint wall 36A connecting the adjacent partition walls 35. On the other hand, as for the contacts 5B, each contact 5B is inserted into between the upper and lower walls 33 and 32 of the housing 3 so that front part of the contact 5B is press-fitted into between the lower wall 32 and a joint wall 36B. The joint wall 36B is provided at the center of the corresponding slot 31 so that the front end substantially corresponds to the back end of the cutout portion 35*a* in a side view. Moreover, the joint wall 36B is configured to connect the adjacent partition walls 35.

In the following description, the contacts 5A located at odd-numbered positions from an end are called just odd contacts or short effective fitting length contacts in some cases. Moreover, the contacts 5B located at even-numbered positions from an end are called just even contacts or long effective fitting length contacts in some cases.

Next, a description is given of a structure to reduce the height around the cam portion 61.

Figure 7A:
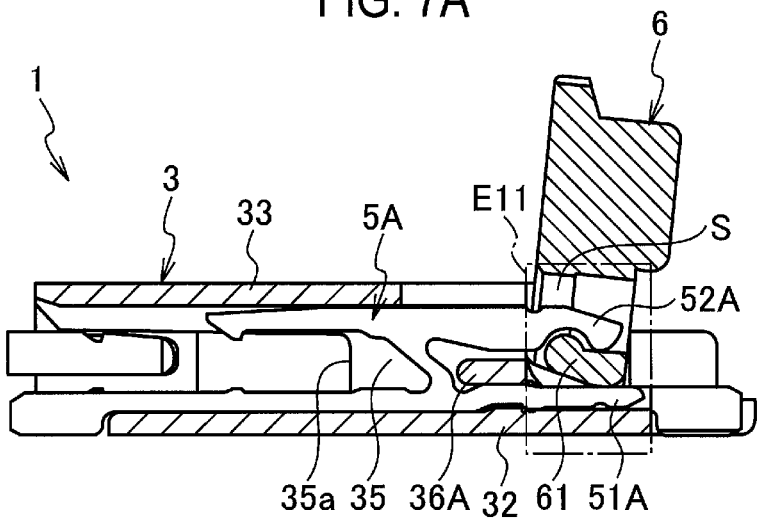
FIGS. 7A and 7B are cross-sectional views schematically illustrating a connector according to a comparative example, FIG. 7A being a cross-sectional view of an odd-numbered contact, FIG. 7B being a cross-sectional view of an even-numbered contact.
Figure 7B:
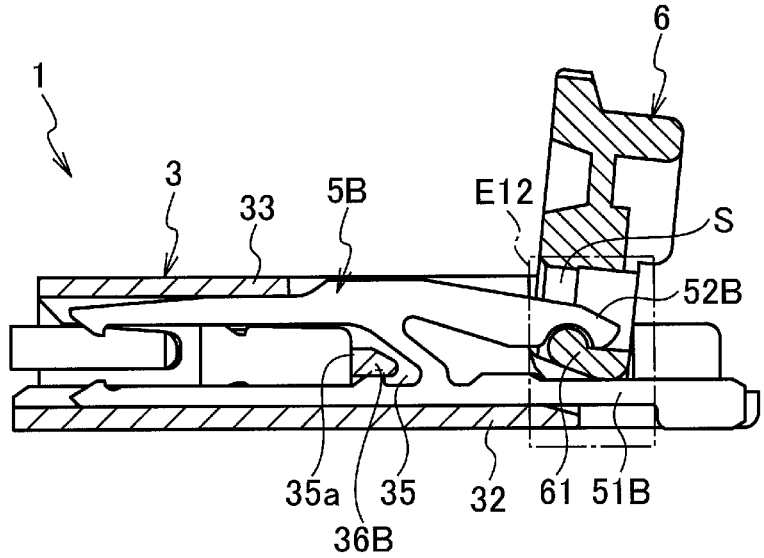

FIG. 7 is a cross-sectional view schematically illustrating a connector 1 according to a comparative example, FIG. 7A illustrating an odd contact, FIG. 7B illustrating an even contact. In order to identify the odd and even contacts, the contacts 5, fixed arms 51, and moving arms 52 of the odd contacts are called "contacts 5A", "fixed arm 51A", and "moving arm 52A", respectively. The contacts 5, fixed arms 51, and moving arms 52 of the even contacts are called "contacts 5B", "fixed arm 51B", and "moving arm 52B", respectively.

As already described, since a conventional connector includes a lot of constituent components around the cam portions 61, the height of the conventional connector is difficult to reduce. Specifically, as illustrated in FIGS. 7A and 7B, there are a lot of constituent components such as the moving arms 52A and 52B, the fixed arms 51A and 51B, and the lower wall 32 of the housing 3, including the cam portions 61, in cam portion peripheral areas E11 and E12. Moreover, when the lever 6 is brought into the locked position, the moving arms 52A and 52B are raised. Accordingly, the space S for the raised moving arms 52A and 52B is required.

FIGS. 8A and 8B are cross-sectional views schematically illustrating the connector 1 according to the embodiment of the present invention, FIG. 8A illustrating an even contact, FIG. 8B illustrating an odd contact. This embodiment employs the following configuration to reduce the height around the cam portions 61.

As for the odd contacts, as illustrated in FIG. 8A, each fixed arm 51A has such a shape that a part thereof corresponding to the cam portion peripheral area E21 is cut off. The cam portion 61 is placed in the cut-out portion (in the portion where the fixed arm 51A is not provided). In other words, the fixed arm 51A is eliminated from the constituent components around the cam portion 61. In such a structure that each contact 5 (fixed arm 51A) is not sandwiched between the lower wall 32 of the housing 3 and the lever 6, the height of the connector 1 of the embodiment in the locked position can be made shorter than that of the connector 1 of the comparative example by the thickness of the fixed arm 51A.

Figure 1:
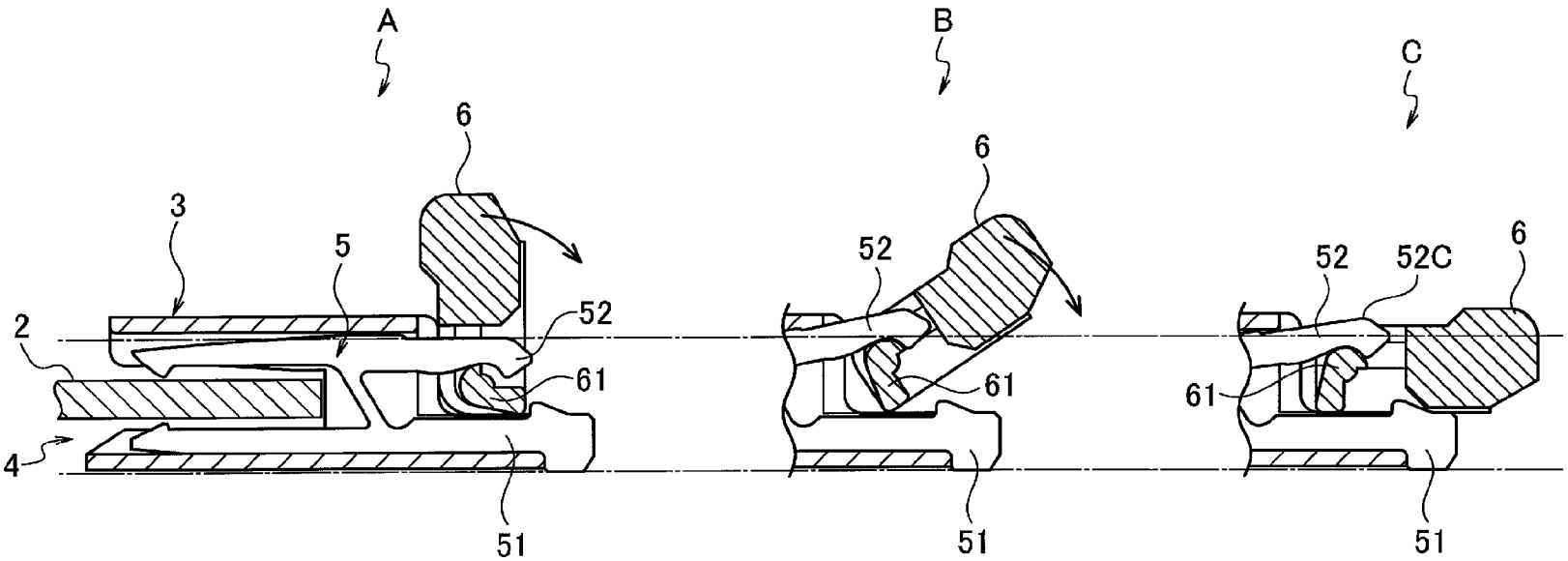
FIG. 1 is a view for explaining the problem of a conventional connector, A illustrating the state of the connector before the lever is turned, B illustrating the state thereof while the lever is being turned, and C illustrating the state thereof after the lever is turned.

Herein, a description is given of the reduction in height of the connector 1 in the locked position in more detail. As previously described, FIG. 1 is a view for explaining the problem of a conventional connector, A illustrating the state of the conventional connector before the lever 6 is turned, B illustrating the state thereof when the lever 6 is being turned, and C illustrating the state thereof after the lever is turned. The connector 1 according to the embodiment is effective in the case where the portion indicated by reference numeral 52C in C is the highest in the moving arm 52. Specifically, the height of the connector 1 in the locked position can be reduced because the moving arm 52 is located at a lower position by the thickness of the fixed arm 51 even if the moving arm 52 is raised by the cam portion 61 in the locked position. Compared to the conventional one, the highest point of the moving arm 52 in the connector 1 of this embodiment can be lowered even if the moving arm 52 is raised by the same amount.

In this embodiment, as described above, the position of the moving arm 52 is lowered including the initial position (the position before the lever 6 is turned), and the position of the moving arm 52 in the locked position is thereby lowered. To be specific, as illustrated in FIG. 8A, in the housing 3, the height position of a placement surface S1 of the fixed arm 51A in the vertical direction is substantially the same as that of a contact surface S2 of the cam portion 61.

In this structure, an end surface 51*e* of the fixed arm 51A in the horizontal direction faces the cam portion 61. To be specific, the end surface in the horizontal direction is an end surface thereof in the direction that the flat cable 2 is inserted. In other words, the end surface 51*e* of the fixed arm 51A in the horizontal direction faces the cam portion 61 in the direction of insertion of the flat cable 2. The connector can be therefore miniaturized in the horizontal direction as well as the height thereof can be reduced in the vertical direction.

As for the even contacts, each cam portion 61 has a columnar shape instead of the key shape. To be specific, in the comparative example, as illustrated in FIG. 7B, the cam portion 61 has a key shape and is required to have a certain height for the bent portion of the key shape. On the other hand, in this embodiment, the cam portion 61 has a columnar shape as illustrated in FIG. 8B. The diameter of the columnar shape, which is not particularly limited, only should be a proper diameter so that the height of the odd contacts equals to that of the even contacts. When the cam portion 61 has a columnar shape as described above, the cam portion 61 does not need to have a portion bent in a key shape. Accordingly, the height of the connector 1 of the embodiment can be shorter than the comparative example by the height of the bent portion of the key shape.

The cam portions 61 corresponding to the even contacts are to prevent the lever 6 from falling off and do not apply pressure to the contacts 5B. Specifically, when the lever 6 is turned, the key-shaped cam portions 61 corresponding to the odd contacts apply pressure to the contacts 5A to push apart the back ends of the fixed arms 51A and moving arms 52A. In this process, the columnar cam portions 61 of the even contacts are kept fitting in recesses 61*a* of the respective moving arms 52B and take a role of preventing the lever 6 from falling off.

As described above, in the connector 1 of the embodiment, the height position of the placement surface S1 of each contact 5 in the vertical direction is equal to that of the contact surface S2 of each cam portion 61. Therefore, the position of each moving arm 52, including the initial position, is lowered, and the position of the moving arm 52 is accordingly lowered in the locked position. The height of the connector 1 can be therefore reduced.

To be specific, each contact 5 includes the moving arm 52 driven by the cam portion 61 and the fixed arm 51 fixed to the housing 3, which are joined to form a substantially H-shape. The fixed arm 51A of each of the contacts 5A having short effective fitting length is shorter than the moving arm 52A and is provided so as to face the moving arm 52A together with the cam portion 61. This structure can lower the position of the moving arm 52 at the locked position as described above. The height of the connector 1 can be therefore reduced.

Moreover, the end surface 51*e*, which is at an end of the fixed arm 51A of each contact 5A having short effective fitting length in the horizontal direction, faces the cam portion 61. The connector 1 can be therefore miniaturized in the horizontal direction as well as the height thereof can be reduced in the vertical direction.

Moreover, the cam portions 61 corresponding to the short effective fitting length contacts rotate on the lower wall 32 of the housing 3. Accordingly, the height of the connector 1 can be reduced by the thickness of the fixed arm 51A.

When the lever 6 is turned, the cam portions 61 corresponding to the short effective fitting length contacts apply pressure to the contacts 5 while the cam portions 61 corresponding to the long effective fitting length contacts prevent the lever 6 from falling off. The thus-configured structure is effective when the signal terminals 21 of the flat cable 2 are arranged in a zigzag manner.

The cam portions 61 corresponding to the long effective fitting length are columnar. When each cam portion 61 has a columnar shape, the cam portion 61 does not need to include a key-shaped bent portion, and the height of the connector 1 can be reduced by the height of the key-shaped bent portion.

The short effective fitting length contacts are the contacts at the odd-numbered positions from an end, and the long effective fitting length contacts are the contacts at the even-numbered positions from an end. The thus-configured structure is effective because, generally, the contacts at the odd-numbered positions have short effective fitting length while the contacts at the even-numbered positions have long effective fitting length.

The preferred embodiment of the present invention is described above, but the present invention is not limited to the embodiment and can be variously changed. For example, the cam portions 61 in the even contacts are columnar in the embodiment but may have another shape as long as the cam portions 61 take a role of preventing the lever 6 from falling off.

Obviously, various changes can be made without departing from the scope of the present invention.

What is claimed is:

1. A connector, comprising:

at least one of a contact;

a housing accommodating the contact;

an insertion opening to which a flat cable can be inserted, the insertion opening being provided in front part of the housing and being defined by upper and lower walls of the housing at the top and bottom; and a lever which is provided in back part of the housing and includes cam portions which bring the contact into pressure contact with the flat cable and establish electrical continuity therebetween when the lever is pivoted, wherein, the contact includes a first contact, and in a state where the first contact is accommodated in the housing and the lever is provided in the housing, a placement surface on which the first contact is placed is substantially same height position in the vertical direction as a contact surface of a corresponding one of the cam portions in the housing.

2. The connector according to claim 1, including a plurality of contacts, and wherein the contacts include a second contact having a different effective fitting length from that of the first contact.

3. The connector according to claim 1, wherein the contact includes a moving arm and a fixed arm which are joined to form a substantially H shape, the moving arm being driven by the corresponding cam portion, the fixed arm being fixed to the housing, and the fixed arm of the first contact is shorter than the moving arm and the fixed arm faces the moving arm and the cam portion faces the moving arm.

4. The connector according to claim 3, wherein an end face of the fixed arm of the first contact faces the corresponding cam portion, the end face being located at an end of the fixed arm in the horizontal direction.

5. The connector according to claim 1, wherein one of the cam portions corresponding to the first contact rotates on the lower wall of the housing as a contact surface.

6. The connector according to claim 2, wherein when the lever is pivoted, the cam portion corresponding to the first contact applies pressure to the first contact while the cam portion corresponding to the second contact prevents the lever from falling off.

7. The connector according to claim 2, wherein the cam portion corresponding to the second contact is columnar.

8. The connector according to claim 2, wherein the first contact has an effective fitting length shorter than that of the second contact, the first contact is located at an odd-numbered position from an end, and the second contact is located at an even-numbered position from the end.

* * * * *